US007741977B2

(12) United States Patent
Buchalo et al.

(10) Patent No.: US 7,741,977 B2
(45) Date of Patent: Jun. 22, 2010

(54) METHOD AND APPARATUS FOR VEHICLE TRAFFIC TIME CALCULATION

(75) Inventors: John E. Buchalo, Barrington, IL (US); Paul M. Bocci, Roselle, IL (US); Richard H. Noens, Palatine, IL (US); Scott J. Propp, Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 365 days.

(21) Appl. No.: 11/957,733

(22) Filed: Dec. 17, 2007

(65) Prior Publication Data

US 2009/0153364 A1 Jun. 18, 2009

(51) Int. Cl.
*G08G 1/01* (2006.01)
*G06G 7/76* (2006.01)

(52) U.S. Cl. ..... 340/933; 340/928; 340/936; 701/117; 701/119

(58) Field of Classification Search ..... 340/933, 340/936, 928; 701/117, 119
See application file for complete search history.

(56) References Cited

U.S. PATENT DOCUMENTS 6,230,011 B1 * 5/2001 Guenther et al. ..... 455/432.1
6,911,918 B2 * 6/2005 Chen ..... 340/995.13
7,142,977 B2 11/2006 Knuuttila et al.

FOREIGN PATENT DOCUMENTS

WO 0208922 A1 1/2002
WO 0225617 A2 3/2002

* cited by examiner

*Primary Examiner*—Donnie L Crosland
(74) *Attorney, Agent, or Firm*—Simon B. Anolick

(57) ABSTRACT

A method and apparatus for calculating the travel time of a vehicle as it transits through multiple locations. The method and apparatus includes a device for detecting a radio signal from a vehicle, attaching information to the radio signal, and transmitting a message packet with the signal and attached information to a central server. The central server stores the message packet. The central server compares the information in the message packet against other stored message packets received from multiple locations. When matching information is found, an algorithm is run to compute a vehicle travel time between two locations.

20 Claims, 8 Drawing Sheets

METHOD AND APPARATUS FOR VEHICLE TRAFFIC TIME CALCULATION

FIELD OF THE INVENTION

The present invention relates generally to vehicle transportation. The invention relates, more particularly, to the calculation of travel times for vehicles traversing through urban areas.

BACKGROUND

Congestion is a major problem in the traffic industry. Traffic congestion is a concern with regard to safety on the roads as well as conservation of energy. County Road Commissions and Departments of Transportation (hereinafter "DOTs") need to be able to identify and relieve traffic congestion. DOTs use programmable traffic signals as a method to relieve traffic congestion. The ability of DOTs to make good use of the programmable traffic signals is limited by the difficulty in obtaining valid traffic flow and congestion information.

Currently, traffic engineers use derivative information to infer the real measure of performance, e.g., vehicle travel times. Vehicle travel time is the time it takes a vehicle to travel between two or more specified points; such as two intersections or a segment of roadway. Derivative information is information; such as traffic densities and flow speeds at points within the roadway network. Derivative information is obtained through the use of physical induction loops imbedded in the roadway, cameras mounted above the roadway, and temporary air-lines run across the roadway. However, presently there is no way to accurately measure the travel time of a vehicle without intruding into or specifically tracking a vehicle.

Alternate approaches of obtaining travel time information include harvesting information about cell phone mobility from the associations between cell phones and cellular towers, as well as from GPS probes to active phones. For example, as a mobile phone talks on a controlled telecom channel, the mobile phone registers with a basestation or cellular tower. A server in the operation center of the wireless service provider tracks the Electric Serial Number ("ESN") of the cell phone within a vehicle. The server then calculates the travel time of the vehicle as it moves between towers. Since the ESN is tied to the account of a subscriber, this method creates a history of where the individual subscriber has been. Therefore, this method requires both the co-operation of the cellular carriers and the trust of the subscribers that privacy will not be violated. Additionally, since the cellular towers are not necessarily located near roadways, and cell sizes may be physically quite large, there is some inherent inaccuracy in this method of calculating the time a vehicle is traveling along a section of roadway or between two points.

What is needed is a method and system deployed without compromising any cellular subscriber trust and that can obtain actual accurate measurements of vehicle travel times between two discrete geographic street locations.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
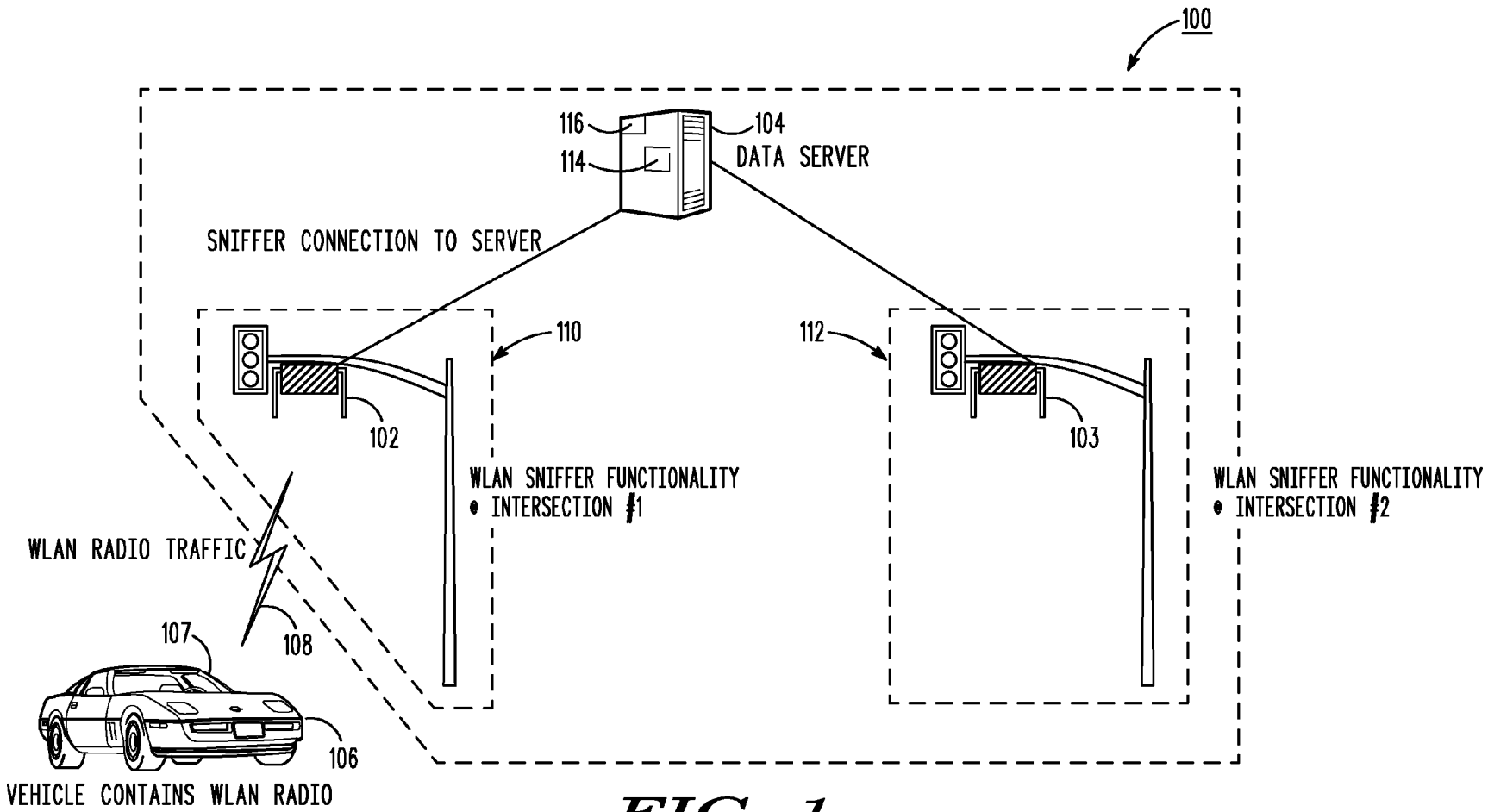
FIG. 1 is an example of a system diagram in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to vehicle travel time calculation. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," "includes," "including" or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control the one or more processors to implement, in conjunction with certain non-processor circuits, some, most, or all of the functions of vehicle travel time calculation described herein. The non-processor circuits may include, but are not limited to, a radio receiver, a radio transmitter, signal drivers, clock circuits, power source circuits, and user input devices. As such, these functions may be interpreted as steps of a method to perform vehicle travel time calculation. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

A method for detecting a radio signal from a vehicle and calculating a time the vehicle travels between two or more locations is disclosed. Various methods include receiving a radio signal from a vehicle, extracting information from the radio signal, transmitting the extracted information to a central server, storing the extracted information at the central server, comparing the extracted information against other extracted information, and calculating a travel time of the vehicle.

A system for detecting a radio signal from a vehicle and calculating a time the vehicle travels between two or more locations is disclosed. The system includes a device for detecting radio signals; a device for storing information associated to the detected signals; a device for comparing the information associated the detected signals to information associated to other detected signals and calculating a travel time of the vehicle.

Referring now to FIG. 1, a system diagram for vehicle travel time calculation in accordance with some embodiments of the invention is shown. A Vehicle Travel Time Calculation System (hereinafter "VTTC") 100 includes a number of Wireless LAN ("WLAN") detection devices (hereinafter "sniffers") 102 and a central server 104. The central server 104 includes a microprocessor 114 and a memory 116 for storing database data. The microprocessor 114 controls the data within the database.

A vehicle 106 contains a Wireless LAN device (hereinafter "WLAN") 107. The WLAN 107 can be a device carried in by a driver or a passenger of the vehicle 106 such as a laptop computer, a personal data assistant, a cell phone with a wireless LAN-card, MP3 player, or any other device with a WLAN chipset contained therein. The WLAN 107 may also be an integrated part of the vehicle 106. The WLAN 107 can be an 802.11b device. However, artisans of ordinary skill in the art will appreciate that the WLAN 107 can be an 802.11a, 802.11g, or 802.11n device or it can be another type of device capable of transmitting a wireless or radio signal.

When in the "ON" state, the WLAN 107 in the vehicle 106 is engaged in WLAN radio traffic 108. The WLAN radio traffic 108 comprises probes, beacons, and messages packets, transmitted by the WLAN 107 on a periodic basis. Probes are signals to perform radio checks to see if there are any other active WLAN devices in the area. A WLAN sends a probe by transmitting signals requesting any receiving (or listening) device to reply with a reply signal. The WLAN 107 is also listening, e.g., ready to receive, for beacons coming from access points (not shown). If the WLAN 107 has a list of previously seen access points in its database, the WLAN 107 will probe (i.e., "active scanning") to see if any of these previously seen access points are accessible. The probes may be transmitted multiple times per second, once per second, once every several seconds, once per minute, or at other predetermined intervals depending upon the WLAN chipset and its programming. Additionally, the listening for beacons (i.e., "passive scanning") may also occur on a periodic basis of multiple times per second, once per second, or at other predetermined intervals depending upon the WLAN chipset. The messages packet comprises a unique identifier (e.g. a MAC or Media Access Control address), a received signal strength, and other information depending upon the WLAN chipset. The MAC address is an identification that is unique to the WLAN 107 device. Each WLAN device contains a MAC address provided as part of the manufacturing and initial configuration process. The received signal strength is the strength of the signal, as measured in decibels (dB), at the time the message is received by the sniffer 102.

As stated hereinabove, the VTTC 100 includes a number of sniffers 102. The sniffers 102 are mounted at intersection #1 110 and intersection #2 112. Artisans of ordinary skill in the art will appreciate that two intersections are shown for exemplary purposes only and that the VTTC 100 may include many more sniffers 102 mounted at many more intersections. The sniffers 102 may be mounted on traffic signals, street lights, utility poles, billboards, cellular towers, or any other structure adjacent to a roadway portion of interest. One sniffer 102 may be mounted at a location or multiple sniffers 102 may be mounted at the location.

Figure 2:
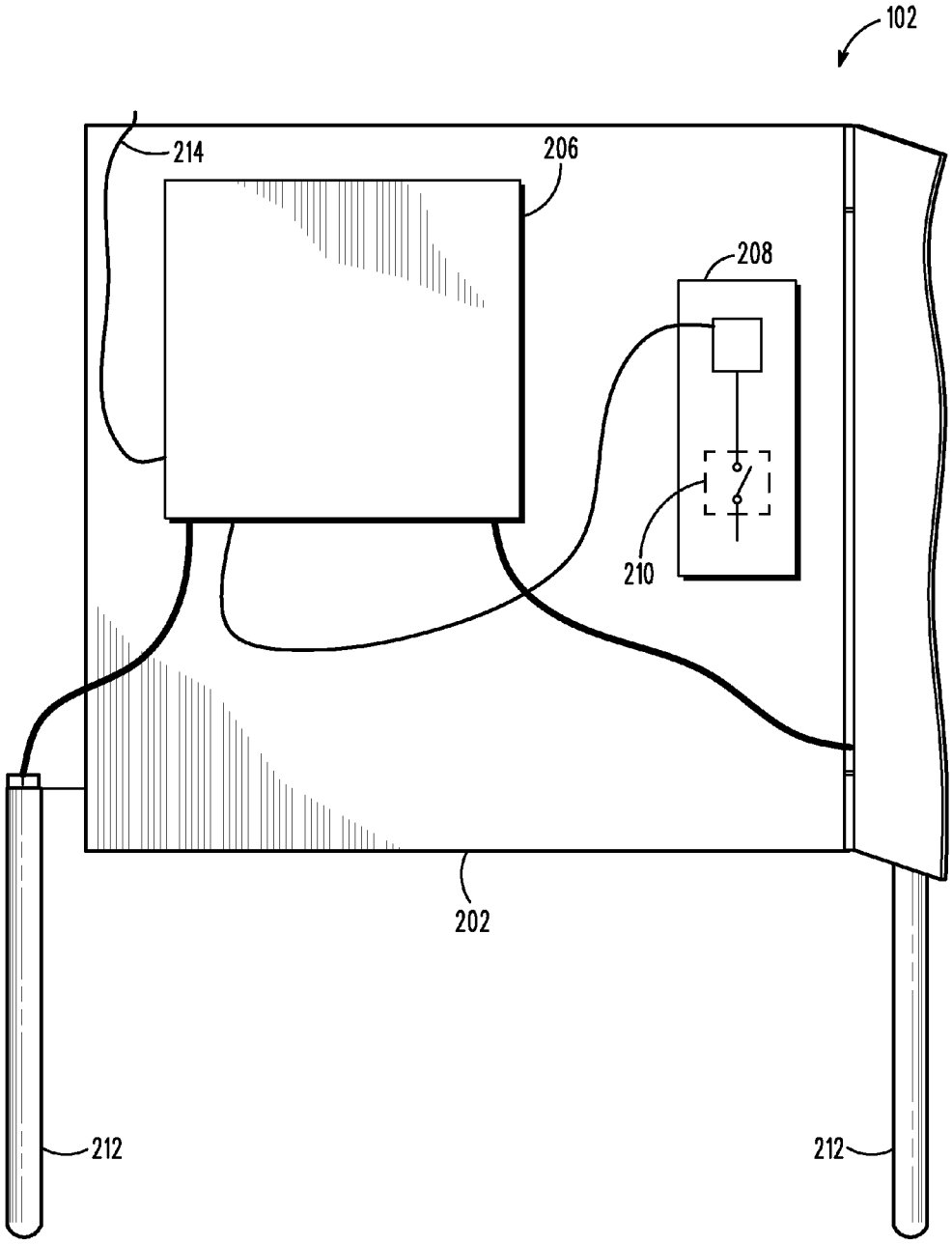
FIG. 2 is an example of a WLAN Sniffer in accordance with some embodiments of the invention.

Referring now to FIG. 2, a sniffer 102 in accordance with some embodiments of the invention is shown. The sniffer 102 can be an independent device that is a dedicated resource for listening to the WLAN radio channels. The sniffer 102 can also be sniffer functionality added to a wireless access point which also provides communications services (not shown). The sniffer 102 can be a receiver capable of listening to every wireless channel. When the sniffer 102 detects wireless activity 108 on a channel, the sniffer 102 remains on that channel with WLAN traffic 108 and listens to all frames until a Frame Check Sequence (FCS) is received. If necessary, the sniffer 102 can be configured and programmed to only listen to relevant frames (such as probe request frames) it receives over the wireless channel. This would allow for a quicker scan across the configured channels.

The sniffer 102 can have an exterior box or case 202. The box 202 can be a weather resistant box or a housing structure that may provide a level of climate control. The box 202 may also have a removable panel or access door 204. The sniffer 102 has a Network Protocol Analyzer (WLAN Detection Device) 206. The network protocol analyzer 206 is connected to a power source 208. The power source 208 may utilize either AC or DC (battery or solar) power. The network protocol analyzer 206 may be connected directly to the power source 208 or through a switch 210. The network protocol analyzer 206 is also connected to an antenna 212. A single antenna 212 may be used or multiple antennas 212 may be used in a diversity mode. The network protocol analyzer 206 has a backhaul connection 214. The backhaul connection 214 is the data connection for providing data to the central server 104 (shown in FIG. 1). The backhaul connection 214 to the central server 104 can be, for example, a connection via an Ethernet segment implemented using Motorola's Canopy backhaul product operating at 5.2 GHz range. The sniffer 102 can also contain a memory, for storing data received by the sniffer 102, (not shown) connected to the network protocol analyzer 206. The sniffer 102 also can be a regular WLAN access point that is reprogrammed such that the WLAN access point only listens for WLAN signals.

Figure 3A:
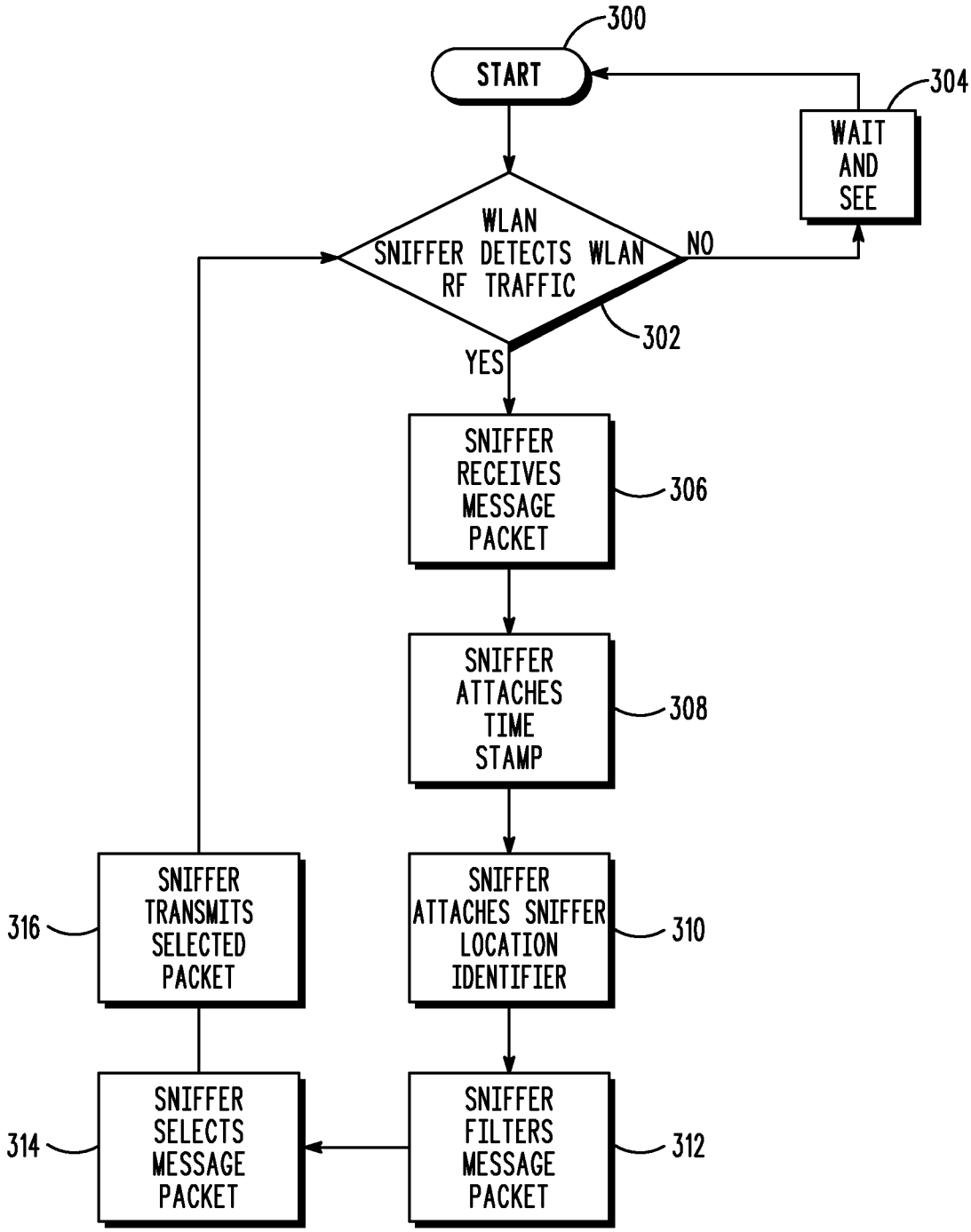
FIG. 3*a* is an exemplary Flow Chart diagram of a WLAN Sniffer Uplink Operation in accordance with some embodiments of the invention.

Referring now to FIG. 3*a*, an exemplary Flow Chart diagram of a WLAN Sniffer Uplink Operation in accordance with some embodiments of the invention is shown. The sniffer initializes 300. The network protocol analyzer 206 scans 302 for WLAN traffic 108. If WLAN traffic is not detected, the sniffer enters a "wait and see"loop 304 that continues to sense for and detect WLAN signal traffic. If WLAN traffic is detected, the network protocol analyzer receives all incoming message packets 306 from the WLAN 107 in the vehicle 106 through the antenna 212 (see FIGS. 1 and 2). The message packets are transmitted from the WLAN 107 as part of the WLAN radio traffic 108 (see FIG. 1). The sniffer 102 attaches a timestamp 308 to each message received from the WLAN 107. The timestamp is a representation of the time when the message was received by the sniffer 102. The sniffer 102 also attaches a sniffer unique location identifier to each message 310. The sniffer unique location identifier is a representation of the geographical location where the sniffer 102 is mounted. For example, the sniffer location identifier identifies that sniffer 102 is located at intersection #1 110. The network protocol analyzer 206 filters the incoming message packets 312. The incoming message packets can include numerous pieces of information, some of which may not be necessary for the calculation of vehicle travel times. Therefore, the network protocol analyzer 206 filters the message packet to remove the unnecessary information. After the incoming message packets have been filtered, the filtered message packets comprise the timestamp, sniffer unique location identifier, MAC address, and received signal strength. The network protocol analyzer 206 selects the filtered message packets 314 to be transmitted as described with respect to FIGS. 3*b*, 4*a* and 4*b* hereinbelow. The sniffer 102 then transmits 316 the selected message packet over the backhaul connection 214 to the central server 104 (see FIGS. 1 and 2). The sniffer 102 continues to scan 302 for WLAN traffic.

Figure 3B:
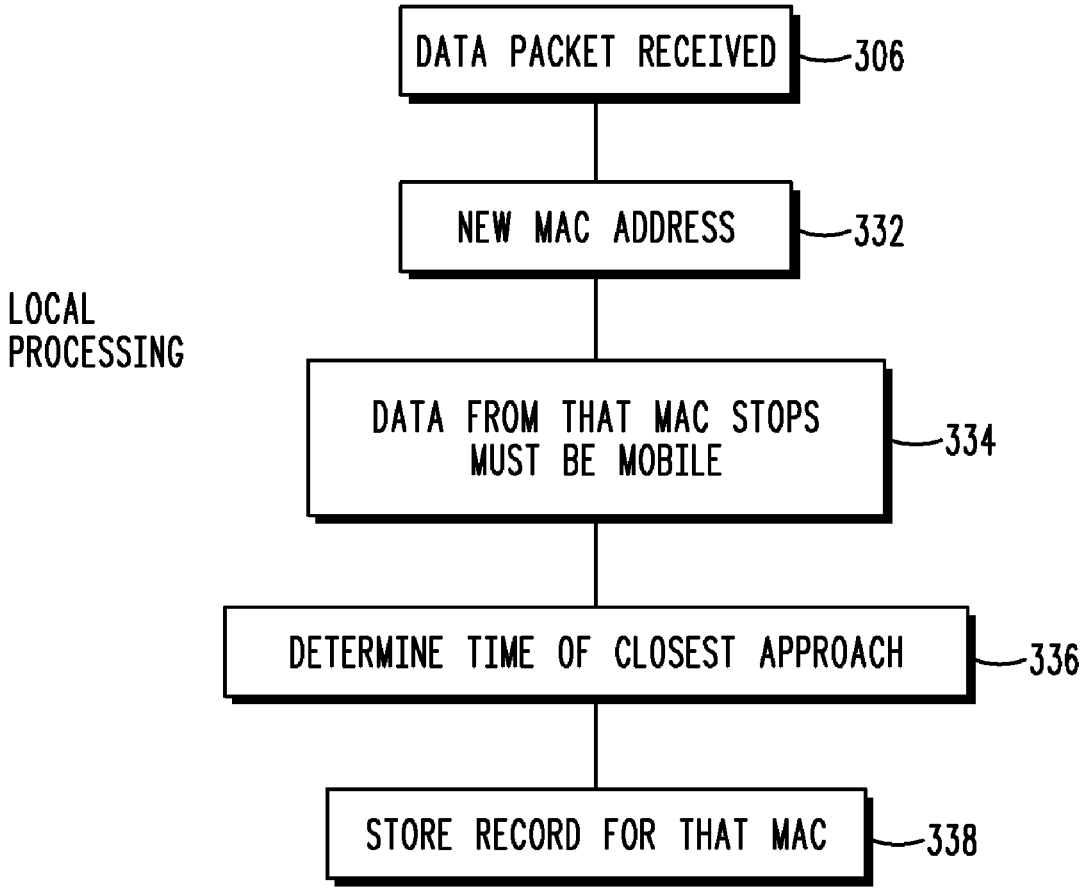
FIG. 3*b* is an exemplary Flow Chart diagram of a WLAN Sniffer Message Selection Operation in accordance with some embodiments of the invention.

Referring now to FIG. 3*b*, an exemplary flow chart diagram of the sniffer message selection process is shown. Once the message packet (data packet) has been received 306 from the WLAN and filtered 312 as described above, the network protocol analyzer 206 determines 332 if a new MAC address has been received. The network protocol analyzer 206 groups all the incoming messages containing a same MAC address. The network protocol analyzer 206 stops receiving incoming message packets containing the same MAC address 334. Then, the network protocol analyzer 206 determines the time of closest approach 336, e.g., the time when the vehicle 106 is closest to the sniffer 102. Further in this step, the network protocol analyzer 206 reads the received signal strength of each incoming message. Additionally, the network protocol analyzer 206 selects the message with the highest received signal strength because it is estimated that the message with the highest received signal strength is the signal to use for the closest time of approach. Thereafter, the network protocol analyzer 206 stores the selected message as a record for that MAC address 338. The remaining non-selected related WLAN messages with the same MAC address are discarded.

Figure 4A:
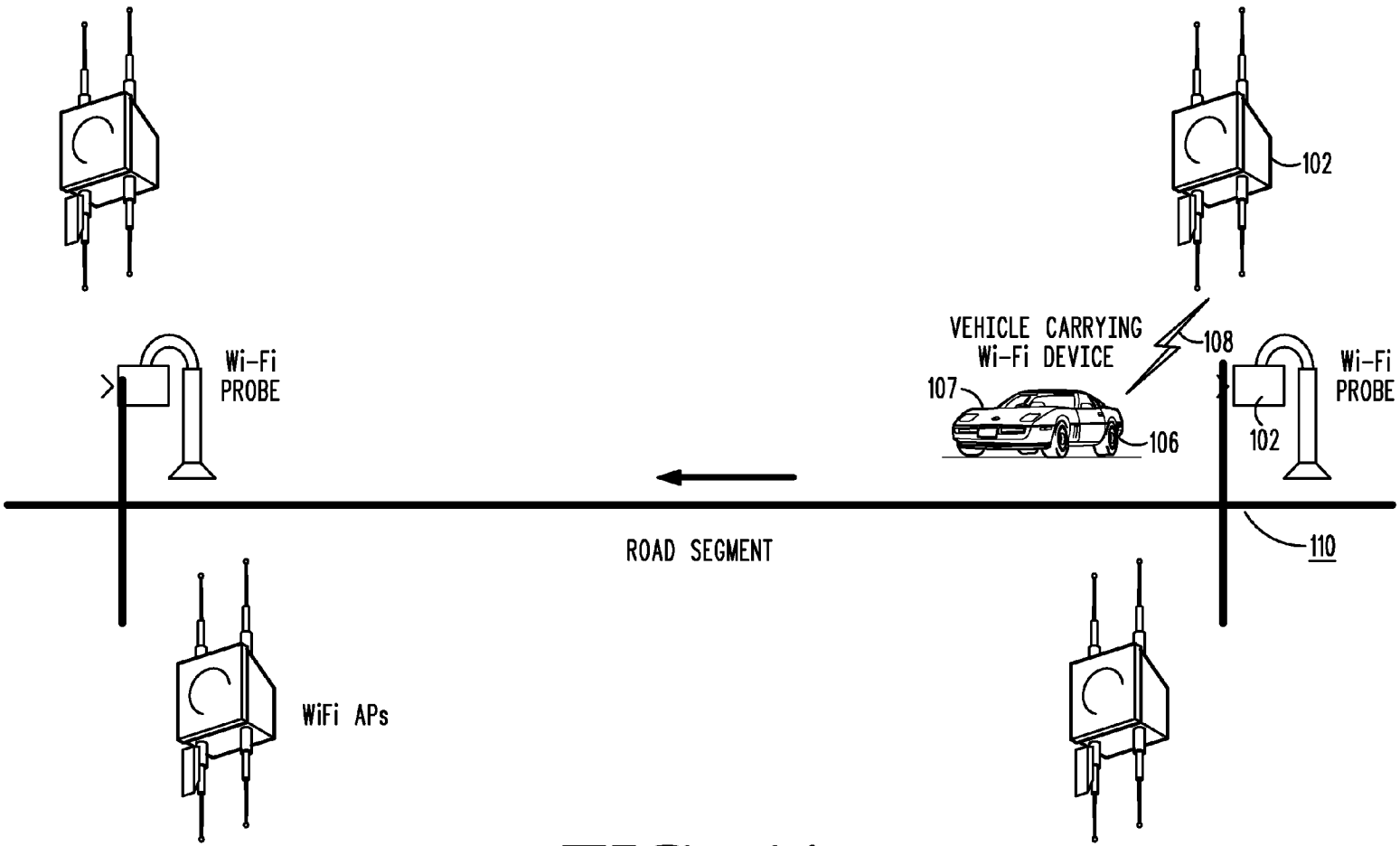
FIGS. 4*a* and 4*b* are exemplary system diagrams in accordance with some embodiments of the present invention.

Referring to FIG. 4*a*, the WLAN 107 in the vehicle 106 transmits its probes 108. As the vehicle 106 approaches intersection #1 110, the sniffer 102 mounted at intersection #1 110 detects the probes 108. The WLAN 107 in the vehicle 106 continues to transmit the message packets. The WLAN 107 in the vehicle 106 transmits the message packets periodically, as described with reference to FIG. 1 hereinabove, multiple times per second, once per second, once every several seconds, or once per minute, depending upon the WLAN chipset.

Therefore, as the vehicle 106 approaches and passes intersection #1 110, the sniffer 102 at intersection #1 110 receives multiple message packets from the WLAN 107 in the vehicle 106. Each of these multiple message packets contains the MAC address of the WLAN 107 and has a received signal strength. The received signal strength for each of the multiple message packets will be different depending upon the proximity of the vehicle 106 to the sniffer 102 at intersection #1 110. The strength of the received signal 108 increases as the vehicle 106 gets closer to the intersection #1 110, e.g., the decibels (dB) of the received signal 108 decrease. The sniffer 102 attaches a time stamp and sniffer unique location identifier on each message packet transmitted by the WLAN 107 in the vehicle 106. The sniffer 102 reads the packets received from the WLAN 107. The sniffer 102 determines which received signal has the lowest decibels (e.g., the highest received signal strength). The signal with the lowest decibels corresponds to the packet sent by the WLAN 107 when the vehicle 106 was closest in proximity to the sniffer 102; such as when the vehicle 106 is directly under, proximate or nearest to, the sniffer 102 at the intersection #1 110. The sniffer 102 selects the packet with the highest received signal (e.g., lowest decibels), provides at least the timestamp, the MAC address, and the sniffer 102 location information identifier for transmission to the central server 104 (see FIG. 1). The remaining non-selected message packets sent from the WLAN 107, are discarded.

Figure 4B:
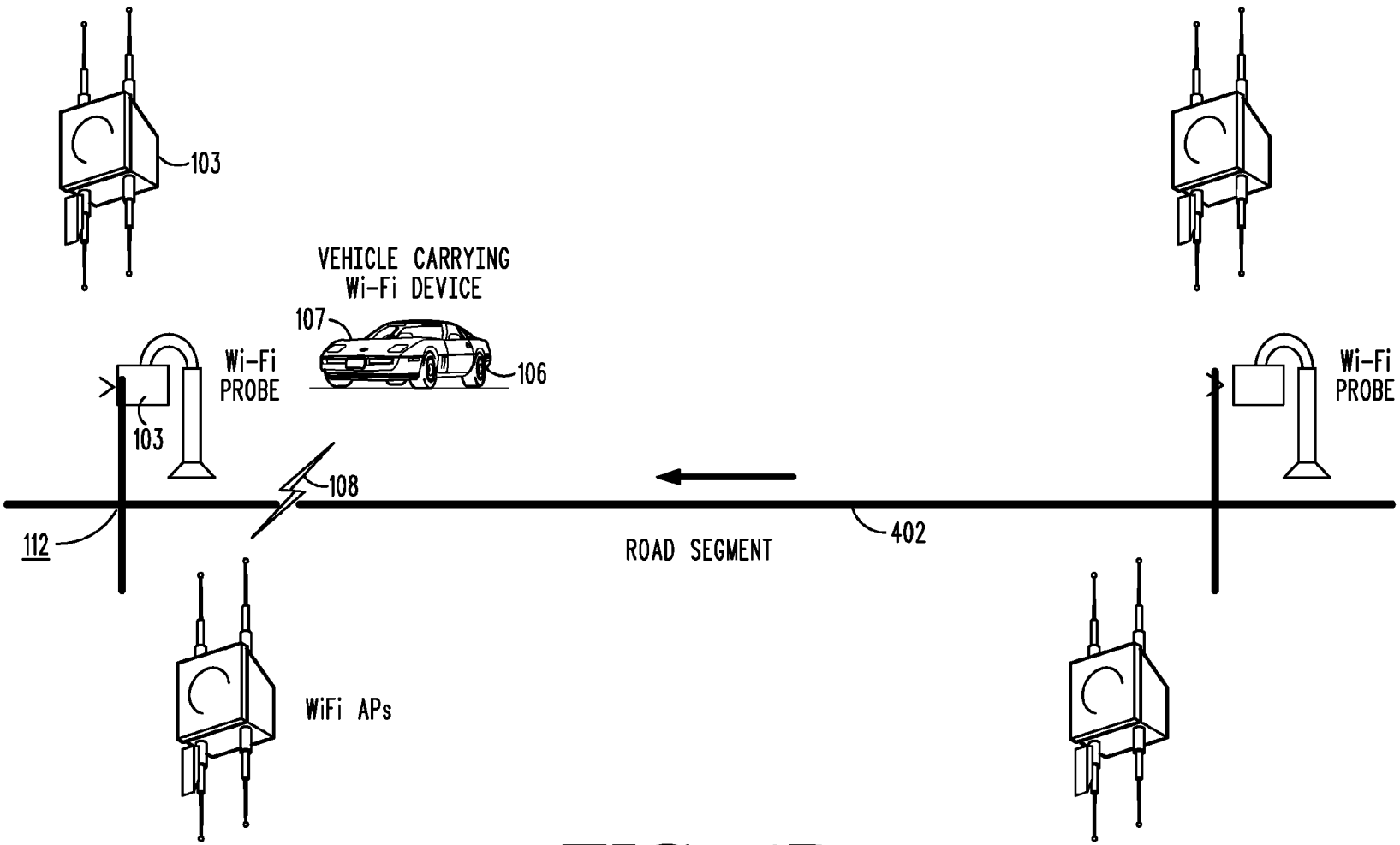

Referring now to FIG. 4*b*, the vehicle 106 has traveled along road segment 402. The vehicle 106 approaches Intersection #2 112. The WLAN 107 in the vehicle 106 transmits its probes 108 as described with reference to FIG. 1 hereinabove. As the vehicle 106 approaches intersection #2 112, the sniffer 103 mounted at intersection #2 112 detects the probes 108. The WLAN 107 in the vehicle 106 continues to transmit the message packets. The WLAN 107 in the vehicle 106 transmits the message packets periodically, as described hereinabove, multiple times per second, once per second, once every several seconds, or once per minute, or at predetermined intervals depending upon the WLAN chipset.

Therefore, as the vehicle 106 approaches and passes intersection #2 112, the sniffer 103 at intersection #2 112 receives multiple message packets from the WLAN 107 in the vehicle 106. Each of these multiple message packets contains the MAC address of the WLAN 107 in the vehicle 106 and has a received signal strength. The received signal strength for each of the multiple message packets will be different depending upon the proximity of the vehicle 106 to the sniffer 103 at intersection #2 112. The strength of the received signal 108 increases as the vehicle 106 gets closer to the intersection #2 112, e.g., the decibels (dB) of the received signal 108 decreases. The sniffer 103 attaches a time stamp and sniffer unique location identifier on each message packet transmitted from the WLAN 107 in the vehicle 106. The sniffer 103 reads the packets received from the WLAN 107. The sniffer 103 determines which received signal has the lowest decibels (e.g., the highest received signal strength). The signal with the lowest decibels corresponds to the packet sent by the WLAN 107 when the vehicle 106 was closest in proximity to the sniffer 103; such as when the vehicle 106 is directly under, proximate or nearest to, the sniffer 103 at the intersection #2 112. The sniffer 103 selects the packet with the highest received signal (e.g., lowest decibels) for transmission to the central server 104 (see FIG. 1). The transmission to the central server comprises the timestamp, indicating when the selected signal was received by the sniffer 103, the unique MAC address contained in the received WLAN signal and the sniffer 103 location. The remaining non-selected message packets sent from the WLAN 107, are discarded.

As stated hereinabove with reference to FIG. 3*a*, the sniffer 103 at intersection #2 112 filters the message packets to discard data not necessary to the calculation of vehicle travel times. The sniffer 103 then transmits the filtered message packets, along with the attached timestamps and sniffer unique location identifiers, to the central server 104 (see FIG.

1). The filtered message packets may be transmitted through a global communication network such as the internet, over a cellular access network, or through a hard-wired connection.

In an additional embodiment, the sniffers 102, 103 can store the message packets, with attached timestamps, in the sniffer 102, 103 memory. The sniffer 102, 103 can then transmit the message packets, with attached timestamp, MAC address, and sniffer 102, 103 unique location identifier, periodically at predetermined intervals.

The central server 104 includes a database (not shown). The database can be setup in many ways known in the art. The central server 104 stores the filtered message packets in the database. Each filtered message packet is stored as a record in the database. The records are stored in the database for a 24 hour period of time. Artisans of ordinary skill in the art will appreciate that the 24 hour period of time is for exemplary purposes and that any designated time period from about 1 minute to one year may be used depending upon the type of time interval statistics and data points necessary for final calculations or traffic trend analysis. The oldest records are normally deleted prior to newer records, but blocks of records may be deleted from time to time depending upon database memory constraints and database management practices. Thus the first record recorded is the first record deleted. The second record recorded is the second record deleted, and so on.

Figure 5:
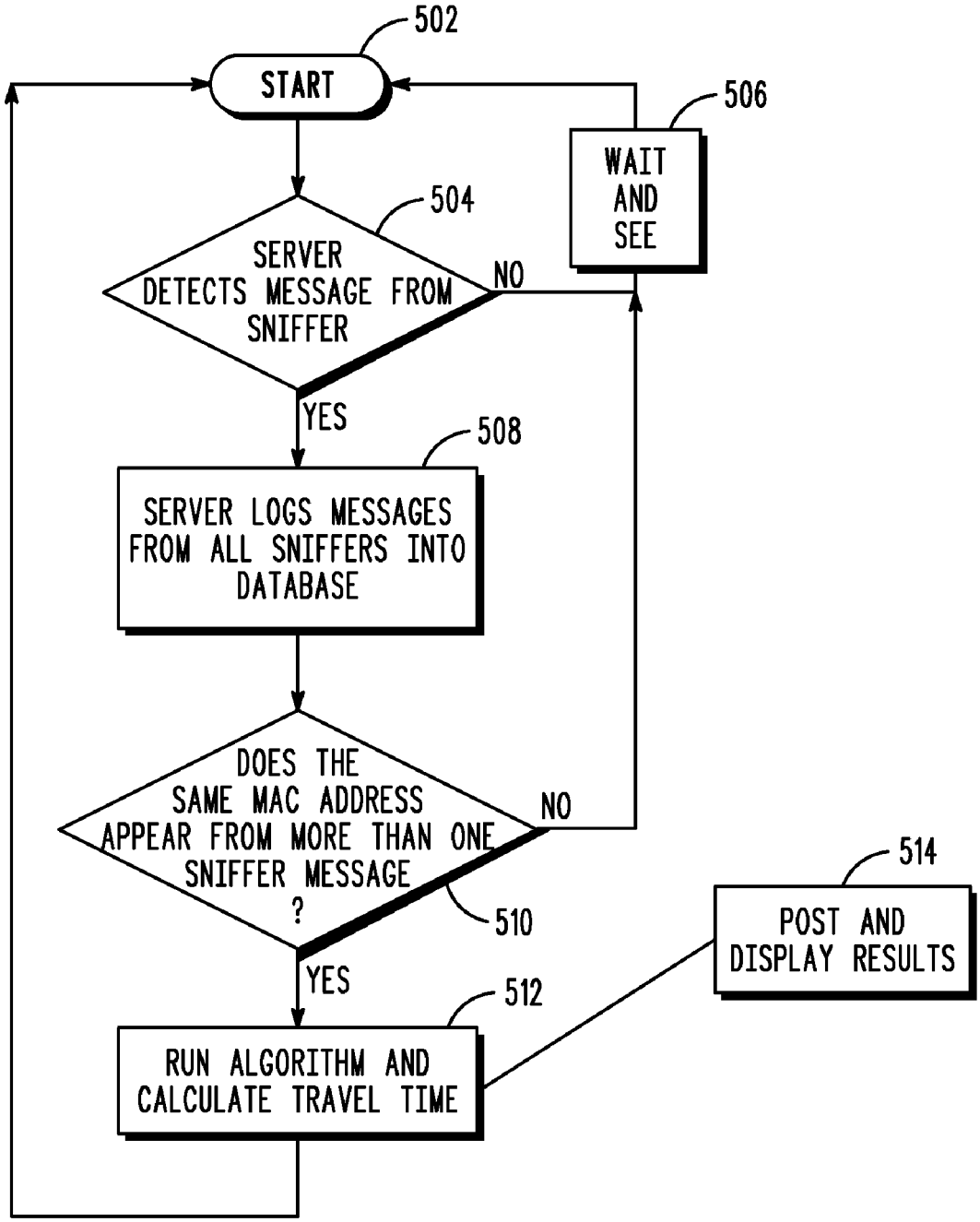
FIG. 5 is an exemplary Flow Chart diagram of a Central Server Operation in accordance with some embodiments of the invention.

Referring now to FIG. 5, an exemplary Flow Chart diagram of a Central Server Operation in accordance with some embodiments of the invention is shown. The central server 104 initiates 502 a scan for messages. The central server 104 continuously scans its receive ports to detect 504 message packets transmitted by the sniffers 102, 103 in the VTTC 100. If no message packets are detected, the central server 104 enters a "wait and see" loop 506 and returns to the start step 502. When a message packet is detected on one of the receive ports, the central server 104 records the message packet in the database 508.

The central server 104 then performs a matching operation 510 to determine if a same MAC address appears in more than one recorded message packet in the database. If no matching MAC addresses are found, the central server 104 returns to the "wait and see" loop 506. If the same MAC address is found in at least two message packets, the central server 104 runs an algorithm 512 to calculate the travel time. The algorithm 512 first confirms that the MAC address was received from two separate sniffer locations, e.g., received at intersection #1 110 and intersection #2 112 in FIG. 1. If the sniffers 102, 103 that received the MAC address were at different locations, the algorithm computes travel times for the distance between the two different sniffer locations.

Figure 6:
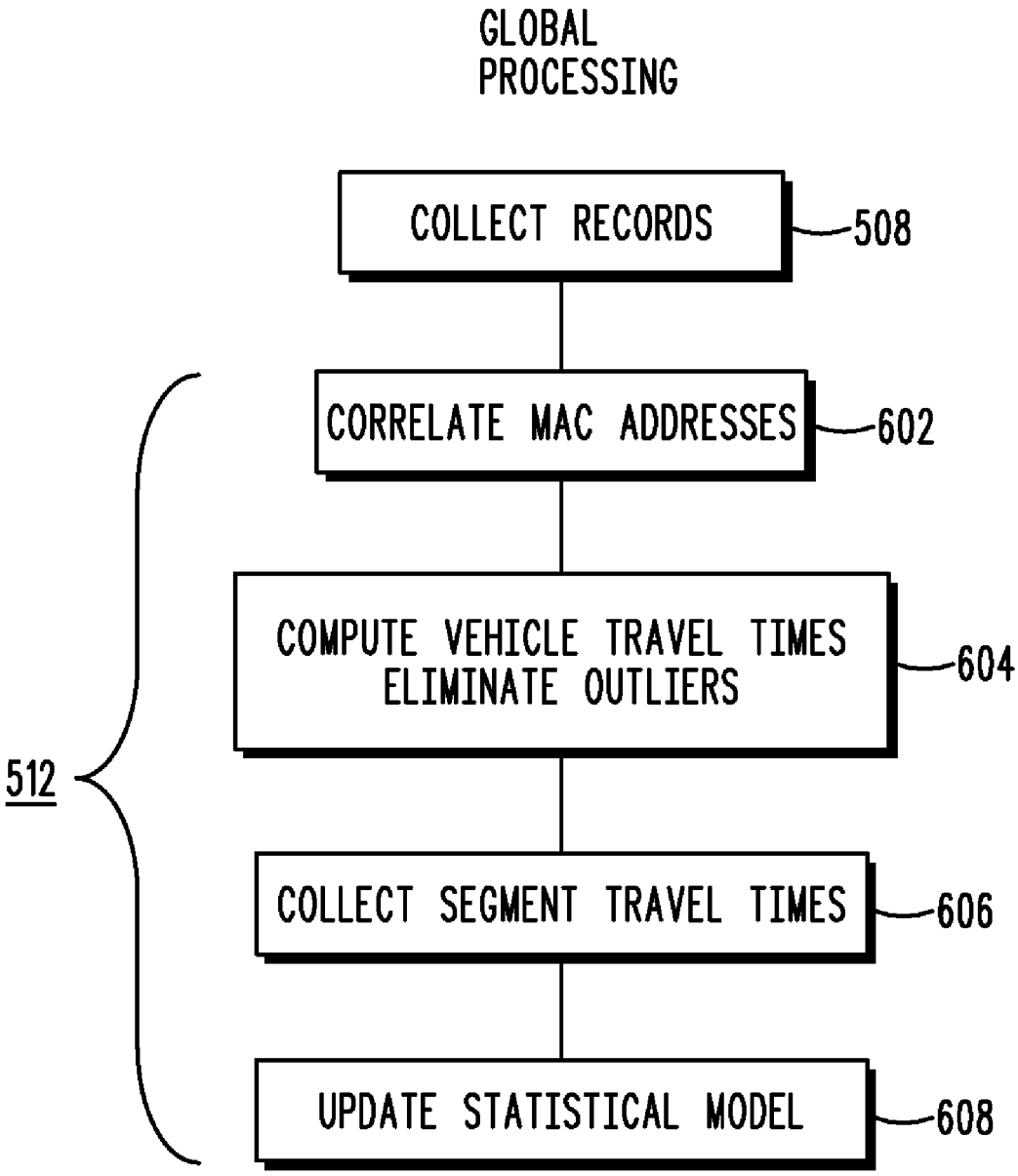
FIG. 6 is an exemplary Flow Chart diagram of a Central Server Algorithm Operation in accordance with some embodiments of the invention.

As illustrated in the flow chart in FIG. 6, the algorithm computes vehicle 106 travel times. The algorithm 512 correlates 602 the MAC addresses. The algorithm differentiates the timestamps to compute travel times 604. The algorithm records the difference in the timestamps. The difference in the timestamps is the time the vehicle 106 traveled from the first sniffer 102 location to the second sniffer 102 location, e.g., from intersection #1 110 to intersection #2 112. Then, the algorithm discards any recorded travel times that are outside a standard deviation from the average. The discarding operation eliminates, for example, the occurrences wherein a pedestrian carrying a WLAN device crosses sniffers 102 at two or more locations. This discarding operation also eliminates when the vehicle 106 stops, such as to refuel, between sniffers at two or more locations. The algorithm records the travel times, for the road segment between the sniffers 102, 103, in the database.

The algorithm then collects segment travel times 606. The timestamps and sniffer locations from the selected messages are also recorded with the travel time records. The algorithm then averages the recorded travel times occurring during preselected time periods throughout the day. As an example, the algorithm can average the travel times occurring between the hours of 7 a.m. and 9 a.m. to obtain an average travel time for the "rush hour" time period. The algorithm 512 then uses this data to update a statistical model 608.

The algorithm can be programmed to anticipate prior entries and driving patterns. If the same MAC addresses is routinely received by the sniffer 102 at the same locations during the same time periods, e.g., at intersection #1 110 and intersection #2 112 during rush hour, the algorithm can look for those same repeated or familiar MAC addresses first.

The central server 104 can then post and display the results of the algorithm 514 in any number of manners as is known in the art. An operator can also perform a query on the results (not illustrated).

In an additional embodiment, the selection of the message packet with the strongest received signal is performed at the central server 104. The sniffer 102 would filter the message packets to discard data not necessary to the calculation of vehicle travel times, as described with reference to FIG. 3*a* hereinabove, and transmit groups of messages stored in the sniffer 102 to the central server 104. The central server 104 performs a second filter operation on the filtered messages received from each sniffer. As stated with reference to FIG. 1 hereinabove, each sniffer receives multiple messages from the WLAN 107 in the vehicle 106 as the vehicle 106 approaches the intersection #1 110. The sniffer 102 filters and transmits all the messages to the central server 104. Therefore, the central server 104 receives multiple messages from each sniffer 102 in the VTTC 100. Each of the multiple messages comprises a MAC address, timestamp, sniffer unique location identifier, and received signal strength. The MAC address is the same in each of the multiple messages. The sniffer unique location identifier is also the same in each of the multiple messages. The multiple messages form a group of messages. This group of messages comprises an initial message received from the WLAN in the vehicle 106 and a last message received from the WLAN in the vehicle 106. The central server 104 reads the group messages from the sniffer 102. The central server 104 compares the MAC addresses and sniffer unique location identifiers of each of the multiple messages in the group of messages. The central server 104 determines that the group of messages defines a single contact with the vehicle 106. Since the sniffer 102 location can be mounted on a traffic signal, a vehicle 106 may pass a sniffer 102 location in a few seconds or the vehicle 106 may stop at the intersection comprising the sniffer 102 location. The central server 104 performs this function to differentiate message packets that resulted from a single contact with the vehicle 106 versus a separate contact with the vehicle 106 that results from the vehicle 106 returning the same sniffer 102 location. The central server 104 selects, from the group of messages, a filtered message with the strongest received signal. The selected message, with the associated MAC address attached time stamp and sniffer location, is recorded in the database. The timestamp of the selected message represents the time that the vehicle 106 would be closest in proximity to the sniffer 102. The remaining messages in the group of messages are discarded.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A system for calculating vehicle travel times between at least two geographic locations, said system comprising:

a first WLAN detection device located at a first geographical location, said first WLAN detection device receives a first WLAN signal from a WLAN device associated with a automobile when said automobile is proximate to said first geographical location, said first WLAN detection device comprises a first network protocol analyzer that creates a first packet comprising a MAC address from said first WLAN signal, a first signal received time stamp provided by said first WLAN detection device, and a first unique location identifier;

a second WLAN detection device located at a second geographical location that is a predetermined distance from said first geographical location, said second WLAN detection device receives a second WLAN signal from said WLAN device when said automobile is proximate to said second geographical location, said second WLAN detection device comprises a second network protocol analyzer that creates a second packet comprising said MAC address from said second WLAN signal, a second signal received time stamp provided by said second WLAN detection device, and a second unique location identifier;

a central server in electronic communication with said first WLAN detection device and said second WLAN detection device, said central server receives said first packet and said second packet, said central server further uses an algorithm to determine a travel time of said automobile between said first and said second geographical locations.

2. The system of claim 1, wherein said central server comprises a database and wherein said central server stores said first packet and said second packet in said database.

3. The system of claim 1, wherein said receiving of said first signal further comprises receiving a plurality of signals from said WLAN device associated with said automobile.

4. The system of claim 3, wherein said first network protocol analyzer selects, from said plurality of signals from said WLAN device associated with said automobile, a strongest signal with a highest received signal strength.

5. The system of claim 1, wherein said algorithm performs a matching operation of said MAC address in said first packet and said MAC address in said second packet.

6. The system of claim 5, wherein said algorithm calculates a difference in time between said first signal received time stamp and said second signal received time stamp when said MAC address in said first packet matches said MAC address in said second packet.

7. The system of claim 6, wherein said algorithm operation further computes an average speed said automobile traveled between said first geographical location and said second geographical location.

8. The system of claim 1, wherein said electronic communication is through a global network.

9. The system of claim 1, wherein said data communication is through a wireless access network.

10. The system of claim 1, where in said first geographical location is proximate to a roadway.

11. A method for calculating a vehicle travel time, the method comprising:

receiving, by a first WLAN signal detection device of a plurality of WLAN signal detection devices, a first WLAN signal transmitted from a wireless device; said first WLAN detection device having a first geographic location;

extracting from the first WLAN signal, a unique identifier of the wireless device;

creating a first transmission packet, by the first WLAN signal detection device, said first transmission packet comprising the unique identifier and a first time stamp representing a time when the first WLAN signal was received by the first WLAN signal detection device;

transmitting, by the first WLAN signal detection device, the first transmission packet to a central server;

storing the first transmission packet in a database in the central server;

receiving, by a second WLAN signal detection device of a plurality of WLAN signal detection devices, a second WLAN signal transmitted from the wireless device; said second WLAN detection device having a second geographic location;

extracting from the second WLAN signal, the unique identifier of the wireless device;

creating a second transmission packet, by the second WLAN signal detection device, said second transmission packet comprising the unique identifier and a second time stamp representing a time when the second WLAN signal was received by the second WLAN signal detection device;

transmitting, by the second WLAN signal detection device, the second transmission packet to the central server;

storing the second transmission packet in the database in the central server;

performing a matching operation of the unique identifier in the first transmission packet with the unique identifier in the second transmission packet;

calculating a difference in time between the first time stamp and the second time stamp when the unique identifier of the first transmission packet and the unique identifier of the second transmission packet match.

12. The travel time calculation method of claim 11, wherein the first transmission packet further comprising a first unique location identifier, the first unique location identifier having a predetermined association with the first geographic location; and the second transmission packet further comprising a second unique location identifier, the second unique location identifier having a predetermined association with the second geographic location.

13. The travel time calculation method of claim 11, wherein the step of receiving a first WLAN signal further comprises receiving a plurality of WLAN signals.

14. The travel time calculation method of claim 13, further comprising, selecting, by the first WLAN signal detection device, comprising determining a highest signal strength from the plurality of WLAN signals and selecting a WLAN signal with a highest received signal strength as the first WLAN signal.

15. The travel time calculation method of claim 13, further comprising, selecting by the central server determining a highest signal strength from the plurality of WLAN signals and selecting a received WLAN signal with a highest received signal strength as the first WLAN signal.

16. The travel time calculation method of claim 14, further comprising averaging the calculated differences, creating a standard deviation of the calculated differences, and removing a received WLAN signal outside the created standard deviation.

17. The travel time calculation method of claim 11, wherein transmitting, by the first WLAN signal detection device, the first transmission packet comprising:

storing first transmission packet in a memory in the first WLAN signal detection device; and transmitting the first transmission packet to the central server at a predetermined time.

18. The travel time calculation method of claim 11, wherein the unique identifier is a MAC address of the wireless device.

19. The travel time calculation method of claim 11, wherein transmitting, by the first WLAN signal detection device further comprises transmitting through a wireless access network.

20. The travel time calculation method of claim 11, wherein transmitting, by the first WLAN signal detection device further comprises transmitting through a global communication network.

* * * * *